US006340242B1

(12) United States Patent
Sandidge

(10) Patent No.: US 6,340,242 B1
(45) Date of Patent: Jan. 22, 2002

(54) STRAP-ON STORAGE, REMINDER AND WATCH DEVICE

(76) Inventor: Toni L. Sandidge, 607 Morgan St., Pittsburgh, PA (US) 15219

( * ) Notice: Subject to any disclaimer, the term of this patent is extended or adjusted under 35 U.S.C. 154(b) by 0 days.

(21) Appl. No.: 09/564,718

(22) Filed: May 4, 2000

(51) Int. Cl.[7] ..... G04B 37/12
(52) U.S. Cl. ..... 368/278; 368/223; 368/283
(58) Field of Search ..... 368/10, 223, 283, 368/278

(56) References Cited

U.S. PATENT DOCUMENTS

| | | | | | |
|---|---|---|---|---|---|
| 3,739,740 | A | | 6/1973 | Fromer | |
| 4,258,354 | A | * | 3/1981 | Carmon et al. | 368/10 |
| 4,444,513 | A | * | 4/1984 | Proellochs et al. | 368/223 |
| 4,483,626 | A | * | 11/1984 | Noble | 368/10 |
| 4,785,981 | A | | 11/1988 | Rodman | |
| 4,964,093 | A | * | 10/1990 | Hiranuma et al. | 368/283 |
| 5,020,037 | A | * | 5/1991 | Raven | 368/10 |
| D318,237 | S | | 7/1991 | Hysek | |
| 5,050,138 | A | * | 9/1991 | Yamada et al. | 368/10 |
| 5,157,640 | A | | 10/1992 | Backner | |
| 5,400,301 | A | | 3/1995 | Rackley | |
| 5,802,014 | A | * | 9/1998 | Danko | 368/10 |
| 5,915,558 | A | * | 6/1999 | Girvetz | 368/10 |
| 6,079,872 | A | * | 6/2000 | Besson | 368/10 |

FOREIGN PATENT DOCUMENTS

| | | | | | |
|---|---|---|---|---|---|
| CA | 2132652 | | * | 3/1996 | 368/10 |
| CH | 682290 | | * | 8/1993 | 368/10 |
| DE | 4303510 | | * | 2/1993 | 368/10 |
| DE | 4413646 | | * | 10/1995 | 368/10 |
| DE | 29720506 | U1 | * | 1/1998 | 368/10 |
| FR | 2518774 | | * | 6/1983 | 368/10 |

* cited by examiner

*Primary Examiner*—Vit Miska
*Assistant Examiner*—Jeanne-Marguerite Goodwin

(57) ABSTRACT

A strap-on storage, reminder, and watch device for allowing the user to conveniently carry one's medication and to remind the user when to take the medication. The strap-on storage, reminder, and watch device includes a plurality of strap members for fastening about a wrist of a user; and also includes a housing having a top wall, an opening in the top wall, and at least one storage compartment disposed therein and being accessible through the opening in the top wall with the housing having bracket members for attaching the housing to the strap members; and further includes a cover member hingedly attached to the housing for releaseably and securely closing over the compartment of the housing with the cover member being essentially a timepiece having a clock face and a clock setting member movably attached thereto; and also includes a reminder assembly for reminding a user when to take medication; and further includes a locking and releasing assembly for locking and releasing the cover member to and from the housing.

16 Claims, 3 Drawing Sheets

STRAP-ON STORAGE, REMINDER AND WATCH DEVICE

BACKGROUND OF THE INVENTION

1. Field of the Invention

The present invention relates to a strap-on medication storage and reminder watch and more particularly pertains to a new strap-on storage, reminder, and watch device for allowing the user to conveniently carry one's medication and to remind the user when to take the medication.

2. Description of the Prior Art

The use of a strap-on medication storage and reminder watch is known in the prior art. More specifically, a strap-on medication storage and reminder watch heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,802,014; 5,400,301; 3,739,740; 5,157,640; 4,785,981; and U.S. Pat. No. Des. 318,237.

While these devices fulfill their respective, particular objectives and requirements, the aforementioned patents do not disclose a new strap-on storage, reminder, and watch device. The inventive device includes a plurality of strap members for fastening about a wrist of a user; and also includes a housing having a top wall, an opening in the top wall, and at least one storage compartment disposed therein and being accessible through the opening in the top wall with the housing having bracket members for attaching the housing to the strap members; and further includes a cover member hingedly attached to the housing for releaseably and securely closing over the compartment of the housing with the cover member being essentially a timepiece having a clock face and a clock setting member movably attached thereto; and also includes a reminder assembly for reminding a user when to take medication; and further includes a locking and releasing assembly for locking and releasing the cover member to and from the housing.

In these respects, the strap-on storage, reminder, and watch device according to the present invention substantially departs from the conventional concepts and designs of the prior art, and in so doing provides an apparatus primarily developed for the purpose of allowing the user to conveniently carry one's medication and to remind the user when to take the medication.

SUMMARY OF THE INVENTION

In view of the foregoing disadvantages inherent in the known types of strap-on medication storage and reminder watch now present in the prior art, the present invention provides a new strap-on on storage, reminder, and watch device construction wherein the same can be utilized for allowing the user to conveniently carry one's medication and to remind the user when to take the medication.

The general purpose of the present invention, which will be described subsequently in greater detail, is to provide a new strap-on storage, reminder, and watch device which has many of the advantages of the strap-on medication storage and reminder watch mentioned heretofore and many novel features that result in a new strap-on storage, reminder, and watch device which is not anticipated, rendered obvious, suggested, or even implied by any of the prior art strap-on medication storage and reminder watch, either alone or in any combination thereof.

To attain this, the present invention generally comprises a plurality of strap members for fastening about a wrist of a user; and also includes a housing having a top wall, an opening in the top wall, and at least one storage compartment disposed therein and being accessible through the opening in the top wall with the housing having bracket members for attaching the housing to the strap members; and further includes a cover member hingedly attached to the housing for releaseably and securely closing over the compartment of the housing with the cover member being essentially a timepiece having a clock face and a clock setting member movably attached thereto; and also includes a reminder assembly for reminding a user when to take medication; and further includes a locking and releasing assembly for locking and releasing the cover member to and from the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new strap-on storage, reminder, and watch device which has many of the advantages of the strap-on medication storage and reminder watch mentioned heretofore and many novel features that result in a new strap-on storage, reminder, and watch device which is not anticipated, rendered obvious, suggested, or even implied by any of the prior art strap-on medication storage and reminder watch, either alone or in any combination thereof.

It is another object of the present invention to provide a new strap-on storage, reminder, and watch device which may be easily and efficiently manufactured and marketed.

It is a further object of the present invention to provide a new strap-on storage, reminder, and watch device which is of a durable and reliable construction.

An even further object of the present invention is to provide a new strap-on storage, reminder, and watch device which is susceptible of a low cost of manufacture with regard to both materials and labor, and which accordingly is then susceptible of low prices of sale to the consuming public, thereby making such strap-on storage, reminder, and watch device economically available to the buying public.

Still yet another object of the present invention is to provide a new strap-on storage, reminder, and watch device which provides in the apparatuses and methods of the prior art some of the advantages thereof, while simultaneously overcoming some of the disadvantages normally associated therewith.

Still another object of the present invention is to provide a new strap-on storage, reminder, and watch device for allowing the user to conveniently carry one's medication and to remind the user when to take the medication.

Yet another object of the present invention is to provide a new strap-on storage, reminder, and watch device which includes a plurality of strap members for fastening about a wrist of a user; and also includes a housing having a top wall, an opening in the top wall, and at least one storage compartment disposed therein and being accessible through the opening in the top wall with the housing having bracket members for attaching the housing to the strap members; and further includes a cover member hingedly attached to the housing for releaseably and securely closing over the compartment of the housing with the cover member being essentially a timepiece having a clock face and a clock setting member movably attached thereto; and also includes a reminder assembly for reminding a user when to take medication; and further includes a locking and releasing assembly for locking and releasing the cover member to and from the housing.

Still yet another object of the present invention is to provide a new strap-on storage, reminder, and watch device that easily and conveniently stores the medication and gives off an alarm when it is time to take the medication.

Even still another object of the present invention is to provide a new strap-on storage, reminder, and watch device that eliminates the user from having to worry about where he/she put the medication or from having to worry about taking one's medication.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
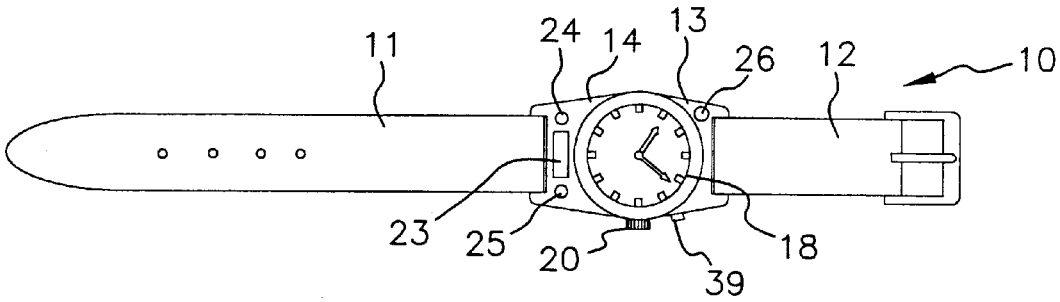
FIG. 1 is a top plan view of a new strap-on storage, reminder, and watch device according to the present invention.
Figure 2:
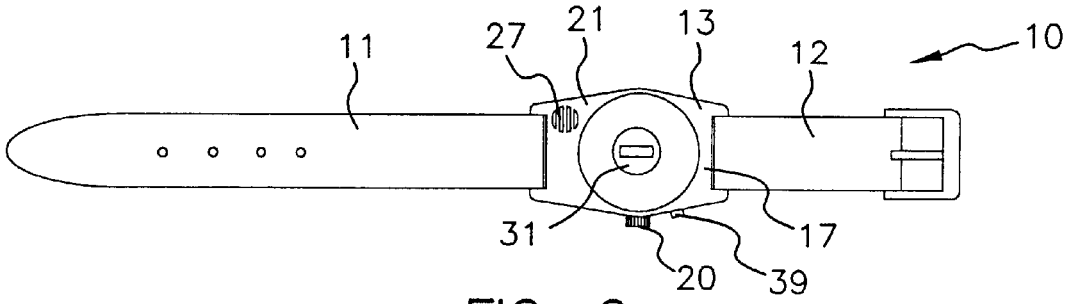
FIG. 2 is a bottom plan view of the present invention.
Figure 3:
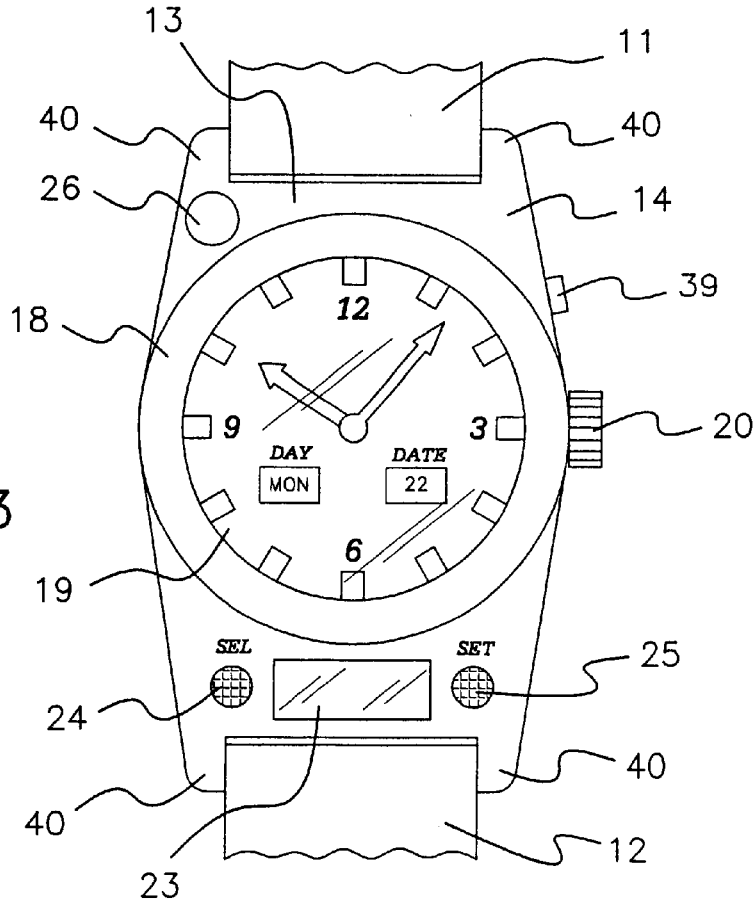
FIG. 3 is a detailed top plan view of the timepiece and the housing of the present invention.
Figure 5:
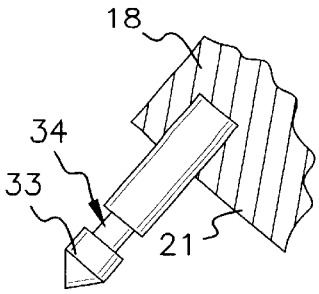
FIG. 5 is a detailed cross-sectional view of the shaft member of the present invention.
Figure 4:
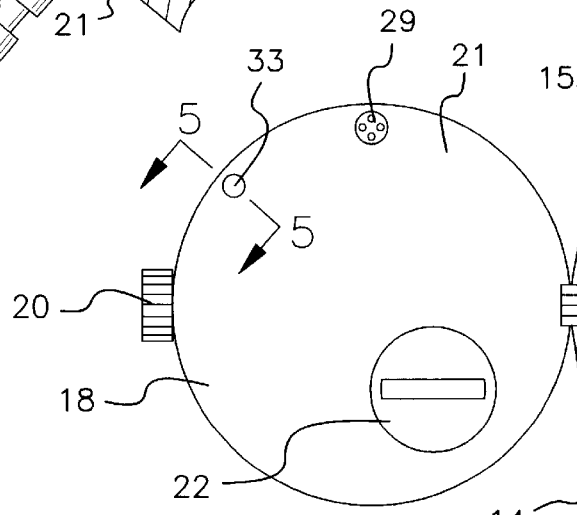
FIG. 4 is a detailed top plan view of the present invention with the cover member being opened to expose the compartments.
Figure 4:
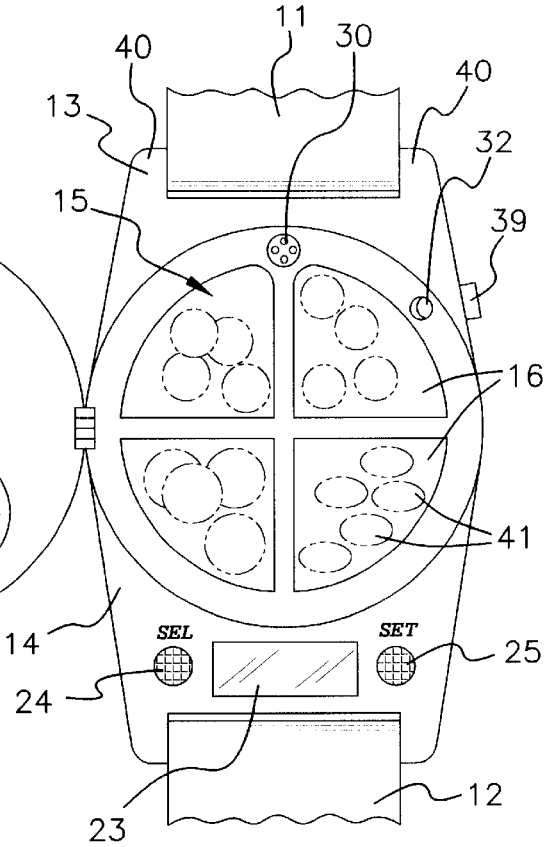
Figure 6:
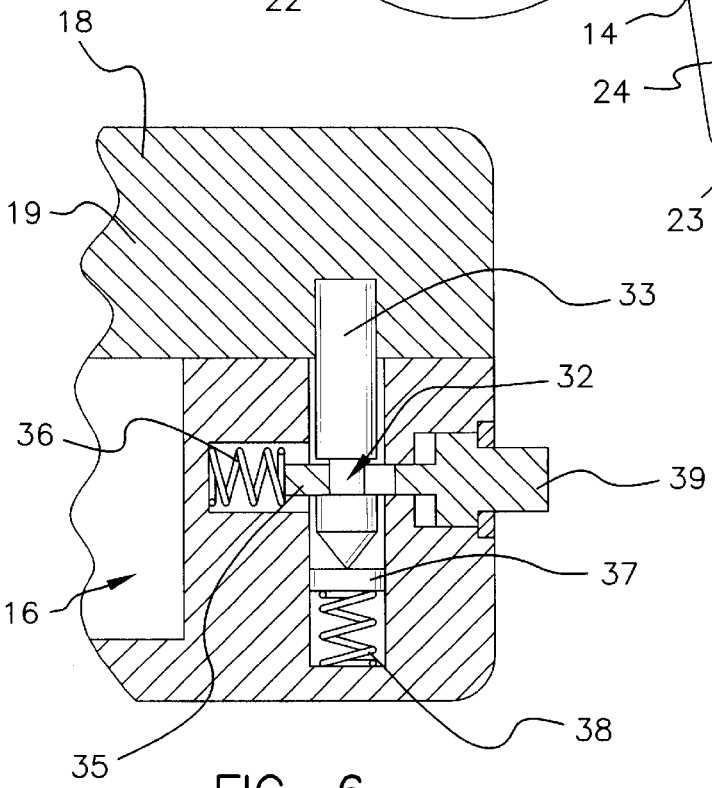
FIG. 6 is a detailed cross-sectional view of the locking and releasing assembly of the present invention.
Figure 7:
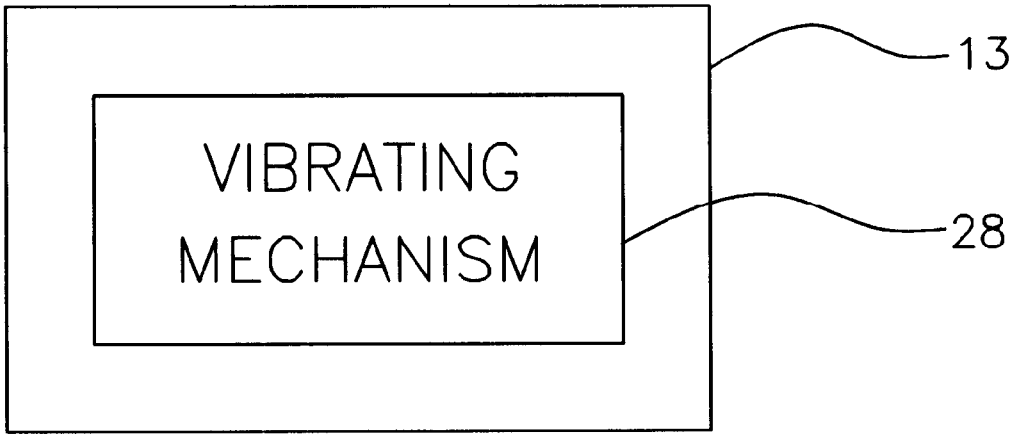
FIG. 7 is a schematic diagram of the housing showing the vibrating mechanism therein.

With reference now to the drawings, and in particular to FIGS. 1 through 7 thereof, a new strap-on storage, reminder, and watch device embodying the principles and concepts of the present invention and generally designated by the reference numeral 10 will be described.

As best illustrated in FIGS. 1 through 7, the strap-on storage, reminder, and watch device 10 generally comprises a plurality of strap members 11,12 for fastening about a wrist of a user, and also comprises a housing 13 having a top wall 14, an opening 15 in the top wall 14, and a plurality of storage compartments 16 disposed therein and being accessible through the opening 15 in the top wall 14. The housing 13 further has means for attaching the housing 13 to the strap members 11,12 including bracket members 40 integrally extending outwardly from ends of the housing 13. The compartments 16 are adapted to receive and store pills 41 for the user to take.

A cover member 18 is hingedly attached to the housing 13 for releaseably and securely closing over the compartments 16 in the housing 13 with the cover member 18 being essentially a timepiece 19 having a clock face and a clock setting member 20 movably attached thereto. The cover member 18 further includes a bottom wall 21, and a battery access cover 22 removably attached to the bottom wall 21.

A reminder means for reminding a user when to take medication includes an information-displaying window 23 conventionally disposed in the top wall 15 of the housing 13, and also includes an alarm-type selecting member 24 depressibly and conventionally disposed in the top wall 14 of the housing 13, and further includes an alarm time-setting member 25 also depressibly and conventionally disposed in the top wall 14 of the housing 13, and also includes a flashable light-emitting member 26 conventionally disposed through the top wall 14 of the housing 13 for indicating an alarm going off, and further includes a speaker 27 conventionally disposed in and through a bottom wall 17 of the housing 13 for emitting a sound alarm, and further includes a vibrating mechanism 28 conventionally disposed in the housing 13 and capable of vibrating the housing 13 upon an alarm going off, and also includes two contact members 29,30 one of which is securely and conventionally disposed in the bottom wall 21 of the cover member 18 near the perimeter thereof and the other of which is securely and conventionally disposed in the top wall 14 of the housing 13, and further includes an alarm power source 31 such as a battery removably and conventionally disposed in the housing 13. The contact members 29,30 are in contactable relationship with one another upon the cover member 18 being closed upon the housing 13 with the contact members 29,30 being adapted to essentially interconnect the timepiece 19 with an alarm mechanism.

A means for locking and releasing the cover member 18 to and from the housing 13 includes a stub shaft 33 being securely and conventionally disposed in and extending from the bottom wall 21 of the cover member 18 near a perimeter thereof, and also includes a bore 32 extending through the top wall 14 of the housing 13 and being adapted to receive the stub shaft 33 upon the cover member 18 being closed upon the housing 13, and further includes a shaft retaining member 35 biasedly and conventionally disposed with a spring 36 in the bore 32 of the housing 13, and also includes a shaft ejecting member 37 movably disposed in the bore 32 of the housing 13 and being biasedly-disposed with a spring member 38 toward a top of the housing 13, and further includes a shaft release member 39 depressibly and conventionally disposed in a side wall of the housing 13 and being in contactable relationship with the shaft retaining member 35 for moving the shaft retaining member 35. The stub shaft 33 includes an end portion having a groove 34 extending therein and about a circumference thereof with the groove 34 being adapted to receive the shaft retaining member 35.

In use, the user sets the times for when the alarm should go off and when he/she is required to take one's medication and places the medication in the storage compartments 16 of the housing 13. The user can also set the type of alarm that he/she wishes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A strap-on pill storage and reminder watch device comprising:

a plurality of strap members for fastening about a wrist of a user;

a housing having a top wall, an opening in said top wall, and at least one storage compartment disposed therein and being accessible through said opening in said top wall, said housing further having means for attaching said housing to said strap members;

a cover member hingedly attached to said housing for releaseably and securely closing over said compartment of said housing, said cover member including a timepiece having a clock face and a clock setting member movably attached thereto;

a reminder means for reminding the user when to take medication; and a means for locking and releasing said cover member to and from said housing;

wherein said cover member further includes a bottom wall, and a battery access cover removably attached to said bottom wall;

wherein said reminder means includes an information-displaying window disposed in said top wall of said housing, an alarm-type selecting member depressibly disposed in said top wall of said housing, an alarm time setting member also depressibly disposed in said top wall of said housing, a flashable light-emitting member disposed through said top wall of said housing for indicating an alarm going off, a speaker disposed in and through a bottom wall of said housing for emitting a sound alarm, a vibrating mechanism disposed in said housing and capable of vibrating said housing upon an alarm going off, contact members one of which is securely disposed in said bottom wall of said cover member near the perimeter thereof and another of which is securely disposed in said top wall of said housing, said contact members being adapted to essentially interconnect said timepiece with an alarm triggering mechanism, and an alarm power source disposed in said housing.

2. A strap-on pill storage and reminder watch device as described in claim 1, wherein said contact members are adapted to contact one another upon said cover member being closed upon said housing, said contact members being adapted to interconnect said timepiece with an alarm triggering mechanism.

3. A strap-on pill storage and reminder watch device as described in claim 1, wherein said means for locking and releasing said cover member includes a stub shaft being securely disposed in and extending from said bottom wall of said cover member near a perimeter thereof, and also includes a bore extending through said top wall of said housing and being adapted to receive said stub shaft upon said cover member being closed upon said housing, and further includes a shaft retaining member biasedly disposed in said bore of said housing, and also includes a shaft ejecting member disposed in said bore of said housing and being biasedly-disposed toward a top of said housing, and further includes a shaft release member depressibly disposed in a side wall of said housing and being abuttable against said shaft retaining member for moving said shaft retaining member.

4. A strap-on pill storage and reminder watch device as described in claim 3, wherein said stub shaft includes an end portion having a groove extending therein and about a circumference thereof, said groove being adapted to receive said shaft retaining member.

5. A strap-on pill storage and reminder watch device as described in claim 1, wherein said means for attaching said housing to said strap members includes bracket members integrally extending outwardly from ends of said housing.

6. A strap-on pill storage and reminder watch device as described in claim 1, wherein said at least one compartment is adapted to receive and store pills for the user to take.

7. A strap-on pill storage and reminder watch device comprising:

a plurality of strap members for fastening about a wrist of a user;

a housing having a top wall, an opening in said top wall, and at least one storage compartment disposed therein and being accessible through said opening in said top wall, said housing further having means for attaching said housing to said strap members including bracket members integrally extending outwardly from ends of said housing, said at least one compartment being adapted to receive and store pills for the user to take;

a cover member hingedly attached to said housing for releaseably and securely closing over said compartment of said housing, said cover member being essentially a timepiece having a clock face and a clock setting member movably attached thereto, said cover member further including a bottom wall, and a battery access cover removably attached to said bottom wall;

a reminder means for reminding the user when to take medication including an information-displaying window disposed in said top wall of said housing, an alarm-type selecting member depressibly disposed in said top wall of said housing, an alarm time setting member also depressibly disposed in said top wall of said housing, a flashable light-emitting member disposed through said top wall of said housing for indicating an alarm going off, a speaker disposed in and through a bottom wall of said housing for emitting a sound alarm, a vibrating mechanism disposed in said housing and capable of vibrating said housing upon an alarm going off, contact members one of which is securely disposed in said bottom wall of said cover member near the perimeter thereof and another of which is securely disposed in said top wall of said housing, and an alarm power source disposed in said housing, said contact members being adapted to contact one another upon said cover member being closed upon said housing, said contact members being adapted to essentially interconnect said timepiece with an alarm triggering mechanism; and a means for locking and releasing said cover member to and from said housing including a stub shaft being securely disposed in and extending from said bottom wall of said cover member near a perimeter thereof, and also including a bore extending through said top wall of said housing and being adapted to receive said stub shaft upon said cover member being closed upon said housing, and further including a shaft retaining member biasedly disposed in said bore of said housing, and also including a shaft ejecting member disposed in said bore of said housing and being biasedly-disposed toward a top of said housing, and further including a shaft release member depressibly disposed in a side wall of said housing and being abuttable against said shaft retaining member for moving said shaft retaining member, said stub shaft including an end portion having a groove extending therein and about a circumference thereof, said groove being adapted to receive said shaft retaining member.

8. A strap-on pill storage and reminder watch device comprising:

a housing having a top wall, an opening in said top wall, and at least one storage compartment disposed therein and being accessible through said opening in said top wall;

a strap assembly mounted on said housing for removably securing said housing to a wrist of a user;

a cover member pivotally mounted on said housing for selectively closing over said compartment of said housing, said cover member including a timepiece having a clock face and a clock setting member movably attached thereto;

a reminder means for reminding the user when to take medication; and a means for selectively locking said cover member in a closed position over said storage compartment in said housing;

wherein said reminder means includes a vibrating mechanism disposed in said housing for vibrating said housing;

wherein said reminder means additionally comprises contact members, one of said contact members being mounted on said cover member and another of said contact members being mounted on said housing, said contact members being adapted to contact one another upon said cover member being closed upon said housing, said contact members being adapted to interconnect said timepiece with an alarm triggering mechanism.

9. A strap-on pill storage and reminder watch device as described in claim 8, wherein said reminder means additionally comprises an information-displaying window disposed in said housing.

10. A strap-on pill storage and reminder watch device as described in claim 9, wherein said reminder means additionally comprises a light-emitting member mounted on said housing for flashing a visual alarm.

11. A strap-on pill storage and reminder watch device as described in claim 10, wherein said reminder means additionally comprises a sound emitting device disposed in said housing for emitting an audible alarm.

12. A strap-on pill storage and reminder watch device as described in claim 11, wherein said reminder means additionally comprises an alarm-type selecting member disposed in said housing, and an alarm time setting member also disposed in said housing.

13. A strap-on pill storage and reminder watch device as described in claim 8 wherein said means for locking and releasing said cover member includes a stub shaft being disposed in and extending from said bottom wall of said cover member near a perimeter thereof, and also includes a bore extending through said top wall of said housing and being adapted to receive said stub shaft upon said cover member being closed upon said housing, and further includes a shaft retaining member disposed in said bore of said housing, and also includes a shaft ejecting member disposed in said bore of said housing and being biased toward a top of said housing, and further includes a shaft release member disposed in a side wall of said housing and being abuttable against said shaft retaining member for moving said shaft retaining member.

14. A strap-on pill storage and reminder watch device as described in claim 13, wherein said stub shaft includes an end portion having a groove extending therein and about a circumference thereof, said groove being adapted to receive said shaft retaining member.

15. A strap-on pill storage and reminder watch device as described in claim 8 additionally comprising means for attaching said housing to said strap assembly, said means comprising bracket members integrally extending outwardly from ends of said housing.

16. A strap-on pill storage and reminder watch device as described in claim 8, wherein said at least one compartment is adapted to receive and store pills for the user to take.

* * * * *